US007059978B2

(12) United States Patent
Yokota et al.

(10) Patent No.: US 7,059,978 B2
(45) Date of Patent: Jun. 13, 2006

(54) GOLF BALL

(75) Inventors: Masatoshi Yokota, Kobe (JP); Takahiro Sajima, Kobe (JP); Seiichiro Endo, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/962,453

(22) Filed: Oct. 13, 2004

(65) Prior Publication Data

US 2005/0130768 A1 Jun. 16, 2005

(30) Foreign Application Priority Data

Dec. 10, 2003 (JP) ..... 2003-411382

(51) Int. Cl.
*A63B 37/12* (2006.01)

(52) U.S. Cl. ..... 473/378

(58) Field of Classification Search ..... 473/378–383
See application file for complete search history.

(56) References Cited

U.S. PATENT DOCUMENTS 5,803,834 A 9/1998 Yamagishi et al.
5,993,332 A 11/1999 Yamagishi et al.
6,302,810 B1 10/2001 Yokota
6,561,929 B1 5/2003 Watanabe
6,616,548 B1 * 9/2003 Kato et al. ..... 473/371
6,855,072 B1 * 2/2005 Yamagishi et al. ..... 473/371
6,887,168 B1 * 5/2005 Hayashi et al. ..... 473/377
2003/0073516 A1 4/2003 Watanable et al.

* cited by examiner

*Primary Examiner*—Raeann Gorden
(74) *Attorney, Agent, or Firm*—Birch, Stewart, Kolasch & Birch, LLP

(57) ABSTRACT

A cover 6 of a golf ball 2 contains an ionomer resin and a thermoplastic elastomer containing a styrene block. The cover 6 has a thickness of 1.0 mm or greater and 1.8 mm or less, and a hardness of 50 or greater and 60 or less. This golf ball 2 has circular dimples having a diameter of 3.90 mm or greater and 4.80 mm or less, and circular dimples having a diameter of less than 3.90 mm. Proportion PN of the number Na of the circular dimples having a diameter of 3.90 mm or greater and 4.80 mm or less, to a total number N of the dimples is equal to or greater than 75%. Volume Va of the circular dimples having a diameter of 3.90 mm or greater and 4.80 mm or less is greater than 300 $mm^3$. Proportion PV of this volume Va to a total volume V of all the dimples is greater than 95.0%. Occupation ratio of total area of the dimples 8 to the surface area of a phantom sphere is equal to or greater than 75%.

7 Claims, 3 Drawing Sheets

GOLF BALL

This application claims priority on Patent Application No. 2003-411382 filed in Japan on Dec. 10, 2003.

BACKGROUND OF THE INVENTION

1. Field of the Invention

The present invention relates to golf balls. More particularly, the present invention relates to golf balls having a core and a cover, with dimples formed on the surface thereof.

2. Description of the Related Art

A golf ball flies accompanied by a back spin upon impact with a golf club. The golf ball falls, rolls on the ground and finally stops. The distance from the launching point to the fall point is referred to as a carry. The distance from the fall point to the point where the ball stopped is referred to as a run or a roll. The distance from the launching point to the point where the ball stopped is referred to as a total distance.

Important performances of the golf ball involve a feel at impact and control performances. Through use of a soft cover, a soft feel at impact and an excellent control performance can be achieved. Golf balls having a soft cover are disclosed in U.S. Pat. No. 5,803,834, U.S. Pat. No. 5,993,332, U.S. Pat. No. 6,302,810, U.S. Pat. No. 6,561,929 and U.S. Ser. No. 2003-73516.

For golf balls, flight performances are also important in addition to the feel at impact and control performances. Golf balls having a soft cover tend to result in a low launch angle, and tend to exhibit a great initial spin rate. Excessive spin leads to a hopping trajectory, thereby resulting in deteriorated flight performance of the golf ball. Golf balls having a soft cover also tend to exhibit a low resilience performance. Insufficiency of the resilience performance also deteriorates the flight performance of the golf ball. An object of the present invention is to provide a golf ball that is excellent in a feel at impact, a control performance and a flight performance.

SUMMARY OF THE INVENTION

The golf ball according to the present invention has a core, a cover, and 240 or more and 360 or less dimples. This cover contains an ionomer resin and a thermoplastic elastomer containing a styrene block as a principal component. This cover has a thickness of 1.0 mm or greater and 1.8 mm or less, and a hardness of 50 or greater and 60 or less. The dimples include (x) two or more kinds of circular dimples having a diameter of 3.90 mm or greater and 4.80 mm or less, and (y) noncircular dimples, or circular dimples having a diameter of less than 3.90 mm. Proportion PN of the number Na of the circular dimples (x) having a diameter of 3.90 mm or greater and 4.80 mm or less to a total number N of the dimples is equal to or greater than 75%. Volume Va of the circular dimples (x) having a diameter of 3.90 mm or greater and 4.80 mm or less is greater than 300 $mm^3$. Proportion PV of this volume Va to a total volume V of all the dimples is greater than 95.0%. Occupation ratio of total area of the dimples to the surface area of a phantom sphere is equal to or greater than 75%.

According to this golf ball, a soft feel at impact and a favorable control performance are achieved by the soft cover. This cover is also excellent in a resilience performance irrespective the softness because the ionomer resin and the thermoplastic elastomer containing a styrene block are included. According to the dimple pattern of this golf ball, hopping is suppressed, and the trajectory is thus optimized. According to this golf ball, the dimples compensate for defects of the cover in terms of the flight performance. This golf ball is excellent in the feel at impact, the control performance and the flight performance.

Preferably, the cover comprises:

(1) 10 parts by weight or greater and 60 parts by weight or less of an ionomer resin having a flexural modulus of 100 MPa or greater and 250 MPa or less which is neutralized with a monovalent metal ion, (2) 10 parts by weight or greater and 60 parts by weight or less of an ionomer resin having a flexural modulus of 100 MPa or greater and 250 MPa or less which is neutralized with a bivalent metal ion and (3) 5 parts by weight or greater and 30 parts by weight or less of a thermoplastic elastomer containing a styrene block, as a principal component.

Preferably, the core is constituted through crosslinking of a rubber composition. This rubber composition contains 100 parts by weight of a base polymer including polybutadiene as a principal component, 20 parts by weight or greater and 45 parts by weight or less of an unsaturated carboxylic acid having 3 to 8 carbon atoms or a metal salt thereof, 0.1 part by weight or greater and 5.0 parts by weight or less of an organic peroxide, and 0.1 part by weight or greater and 5.0 parts by weight or less of an organic sulfur compound. Amount of compressive deformation of this core is 3.0 mm or greater and 4.0 mm or less. Surface hardness of this core is 50 or greater and 58 or less. The difference between the surface hardness and the center hardness of this core is 8 or greater and 22 or less. The difference between the hardness of the cover and the surface hardness of the core is equal to or less than 10.

DESCRIPTION OF THE PREFERRED EMBODIMENTS

The present invention is hereinafter described in detail with appropriate references to the accompanying drawing according to the preferred embodiments of the present invention.

Figure 1:
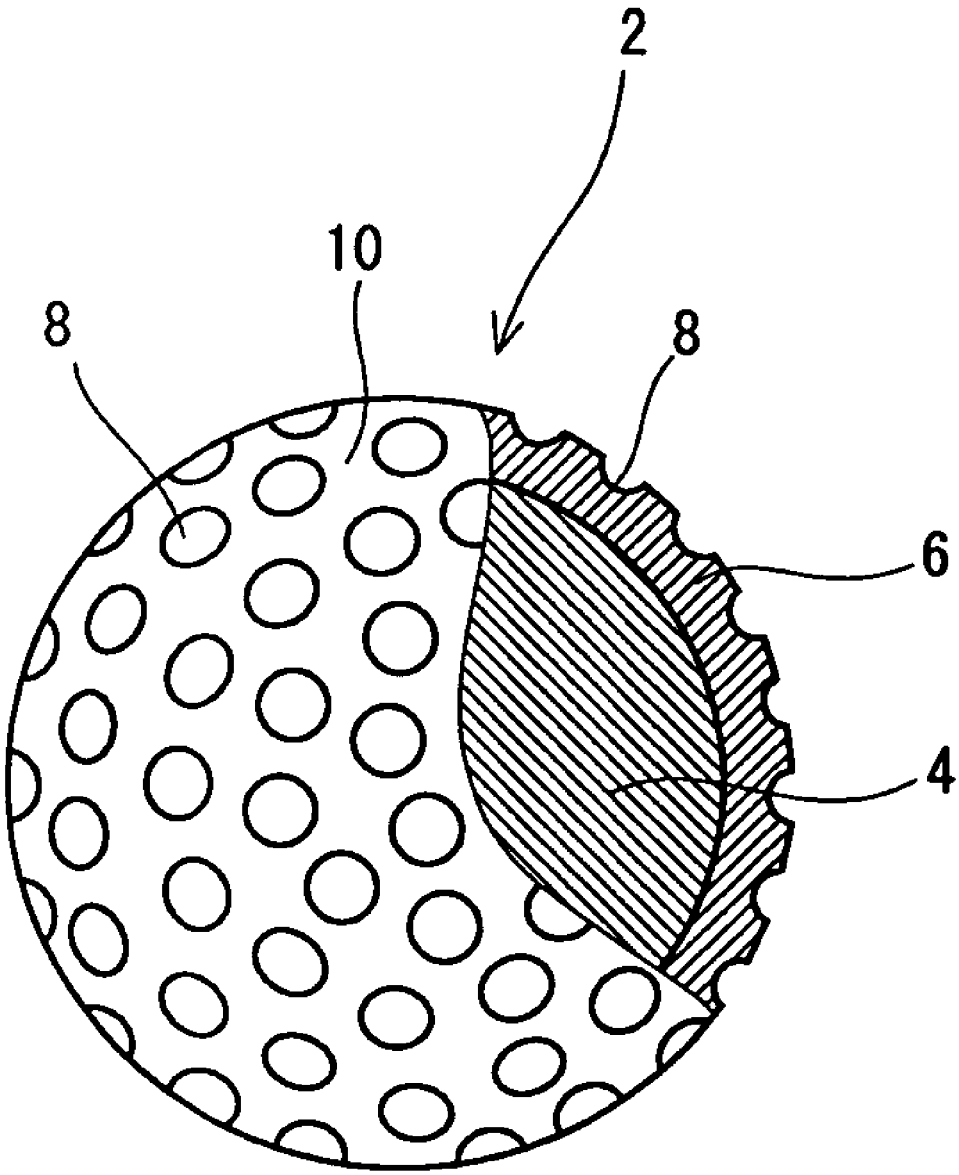
FIG. 1 is a schematic cross-sectional view illustrating a golf ball according to one embodiment of the present invention.

A golf ball 2 shown in FIG. 1 has a spherical core 4 and a cover 6. Numerous dimples 8 are formed on the surface of the cover 6. Of the surface of the golf ball 2, parts other than the dimples 8 are lands 10. This golf ball 2 has a paint layer and a mark layer to the external side of the cover 6, although these layers are not shown in the Figure. The golf ball 2 may have a mid layer between the core 4 and the cover 6.

The cover 6 herein means an outermost layer other than the paint layer and the mark layer. Although there exist golf balls having a cover with a two-layered structure, in this case, the outside layer corresponds to the cover 6 herein.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and particularly preferably equal to or greater than 45.00 g. From the standpoint of conformity to a rule defined by USGA, the weight is preferably equal to or less than 45.93 g.

The core 4 is obtained through crosslinking of a rubber composition. Illustrative examples of a base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred. In the case where other rubber is used in combination with a polybutadiene, to employ a polybutadiene as a principal component is preferred. Specifically, it is preferred that a proportion of polybutadiene to the entire base rubber be equal to or greater than 50% by weight, and particularly equal to or greater than 80% by weight. High cis polybutadienes which have a percentage of the cis-1, 4 bond of equal to or greater than 40%, and particularly equal to or greater than 80% are particularly preferred.

For crosslinking of the core 4, a co-crosslinking agent is usually used. Preferable co-crosslinking agent in light of the resilience performance is a monovalent or bivalent metal salt of an α, β-unsaturated carboxylic acid having 3 to 8 carbon atoms. Specific examples of the preferable co-crosslinking agent include zinc diacrylate, magnesium diacrylate, zinc dimethacrylate and magnesium dimethacrylate. Zinc diacrylate is particularly preferred on the ground that a high resilience performance can be achieved.

As a co-crosslinking agent, also an α, β-unsaturated carboxylic acid having 3 to 8 carbon atoms, and a metal oxide may be blended. Both components react in the rubber composition to give a salt. This salt serves as a co-crosslinking agent. Examples of preferable α, β-unsaturated carboxylic acid include acrylic acid and methacrylic acid, and acrylic acid is particularly preferred. Examples of preferable metal oxide include zinc oxide and magnesium oxide, and zinc oxide is particularly preferred.

The amount of the co-crosslinking agent to be blended is preferably 20 parts by weight or greater and 45 parts by weight or less per 100 parts by weight of the base rubber. When the amount is less than the above range, the resilience performance of the golf ball 2 may become insufficient. In this respect, the amount is more preferably equal to or greater than 25 parts by weight. When the amount is beyond the above range, a hard feel at impact of the golf ball 2 may be experienced. In this respect, the amount is particularly preferably equal to or less than 40 parts by weight.

In the rubber composition for use in the core 4, an organic peroxide may be preferably blended together with the co-crosslinking agent. The organic peroxide is responsible for a crosslinking reaction. By blending the organic peroxide, the resilience performance of the golf ball 2 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the organic peroxide to be blended is preferably 0.1 part by weight or greater and 5.0 parts by weight or less per 100 parts by weight of the base rubber. When the amount is less than the above range, the resilience performance of the golf ball 2 may become insufficient. In this respect, the amount is more preferably equal to or greater than 0.3 part by weight, and particularly preferably equal to or greater than 0.5 part by weight. When the amount is beyond the above range, a hard feel at impact of the golf ball 2 may be experienced. In this respect, the amount is more preferably equal to or less than 3.0 parts by weight, and particularly preferably equal to or less than 2.0 parts by weight.

It is preferred that an organic sulfur compound is blended in the rubber composition for use in the core 4 together with the crosslinking agent and the organic peroxide. The organic sulfur compound is responsible for the crosslinking reaction. Blending of the organic sulfur compound improves the resilience performance of the golf ball 2. Examples of suitable organic sulfur compound include diphenyl disulfide and bis(pentabromophenyl)disulfide.

The amount of the organic sulfur compound to be blended is preferably 0.1 part by weight or greater and 5.0 parts by weight or less per 100 parts by weight of the base rubber. When the amount is less than the above range, the resilience performance of the golf ball 2 may become insufficient. In this respect, the amount is more preferably equal to or greater than 0.3 part by weight. When the amount is beyond the above range, a hard feel at impact of the golf ball 2 may be experienced. In this respect, the amount is more preferably equal to or less than 3.0 parts by weight, and particularly preferably equal to or less than 1.5 parts by weight.

In the core 4 may be blended a filler for the purpose of adjusting specific gravity and the like. Illustrative examples of suitable filler include zinc oxide, barium sulfate, calcium carbonate and magnesium carbonate. Powder consisting of a highly dense metal may be also blended as a filler. Specific examples of the highly dense metal include tungsten and molybdenum. The amount of the filler to be blended is determined ad libitum so that the intended specific gravity of the core 4 can be accomplished. Particularly preferable filler is zinc oxide. Zinc oxide serves not only as a mere agent for adjusting specific gravity but also as a crosslinking activator. Various kinds of additives such as, an anti-aging agent, a coloring agent, a plasticizer, a dispersant and the like may be blended in an appropriate amount to the core 4 as needed. The core 4 may be also blended with crosslinked rubber powder or synthetic resin powder.

The amount of compressive deformation of the core 4 is preferably 3.0 mm or greater and 4.0 mm or less. When the amount of compressive deformation is less than the above range, an insufficient feel at impact of the golf ball 2 may be experienced, and a hopping trajectory may be provided due to an excessive spin. In this respect, the amount of compressive deformation is more preferably equal to or greater than 3.3 mm. When the amount of compressive deformation is beyond the above range, a heavy feel at impact may be experienced. In this respect, the amount of compressive deformation is more preferably equal to or less than 3.7 mm.

Upon the measurement of the amount of compressive deformation, a spherical body which is a subject to be measured is first placed on a hard plate made of a metal. Next, a cylinder made of a metal is rendered to descend gradually toward the spherical body. Accordingly, the spherical body, which is intervened between the bottom face of this cylinder and the hard plate, is deformed. A migration distance of the cylinder, starting from the state in which an initial load of 98 N is applied to the spherical body up to the state in which a final load of 1274 N is applied thereto, is the amount of compressive deformation.

Surface hardness H1 of the core 4 is preferably 50 or greater and 58 or less. When the surface hardness H1 is less than the above range, a heavy feel at impact of the golf ball 2 may be experienced. In this respect, the surface hardness H1 is more preferably equal to or greater than 52. When the surface hardness H1 is beyond the above range, a hard feel at impact of the golf ball 2 may be experienced. In this respect, the surface hardness H1 is more preferably equal to or less than 56. The surface hardness H1 is measured by pressing a Shore D type spring hardness scale specified in "ASTM-D 2240-68" against the surface of the core 4. For a reference, the surface hardness measured with a JIS-C type hardness scale is preferably 75 or greater and 85 or less.

The difference (H1−H2) between the surface hardness H1 of the core 4 and the center hardness H2 of the core 4 is preferably 8 or greater and 22 or less. The difference (H1−H2) affects a deformative behavior of the golf ball 2 upon impact with a golf club. By setting the difference (H1−H2) within the aforementioned range, an appropriate amount of deformation can be generated, thereby providing a proper launch angle and spin rate. The difference (H1−H2) is preferably equal to or greater than 10. The difference (H1−H2) is more preferably equal to or less than 20. The center hardness H2 is measured by cutting the core 4 in half, and pressing the aforementioned Shore D type spring hardness scale against the center. For a reference, the difference between the surface hardness and the center hardness as measured with a JIS-C type hardness scale is preferably 10 or greater and 27 or less.

Crosslinking temperature of the core 4 is generally 140° C. or greater and 180° C. or less. Crosslinking time period of the core 4 is generally 10 minutes or longer and 60 minutes or less. Specific gravity of the core 4 is 0.90 or greater and 1.40 or less. Diameter of the core 4 is generally 36.0 mm or greater and 41.5 mm or less. The core 4 may have two or more layers.

An ionomer resin and a thermoplastic elastomer containing a styrene block are included in the cover 6. This cover 6 is soft as well as excellent in a resilience performance. This golf ball is excellent in a control performance, a feel at impact and a flight performance. It is preferred that proportion of total amount of the ionomer resin and the thermoplastic elastomer containing a styrene block to a total amount of the base polymer of the cover 6 is equal to or greater than 50% by weight, further more equal to or greater than 60% by weight, yet more equal to or greater than 70% by weight, still more equal to or greater than 80% by weight, and still more equal to or greater than 90% by weight.

For the cover 6, (1) an ionomer resin having a flexural modulus of 100 MPa or greater and 250 MPa or less which is neutralized with a monovalent metal ion, (2) an ionomer resin having a flexural modulus of 100 MPa or greater and 250 MPa or less which is neutralized with a bivalent metal ion and (3) a thermoplastic elastomer containing a styrene block are preferably used in combination. The flexural modulus is measured in accordance with a standard of "ASTM-D 790". The ionomer resin having a flexural modulus of 100 MPa or greater and 250 MPa or less is responsible for the resilience performance of the golf ball 2. The thermoplastic elastomer containing a styrene block is responsible for the feel at impact and the control performance of the golf ball 2. Through the use of the ionomer resin which is neutralized with a monovalent metal ion and the ionomer resin which is neutralized with a bivalent metal ion, the resilience performance of the golf ball 2 is more significantly improved.

The amount of the ionomer resin (1) having a flexural modulus of 100 MPa or greater and 250 MPa or less which is neutralized with a monovalent metal ion to be blended is preferably 10 parts by weight or greater and 60 parts by weight or less per 100 parts by weight of the total base polymer. The amount is more preferably equal to or greater than 20 parts by weight, and particularly preferably equal to or greater than 30 parts by weight. Examples of the monovalent metal ion for use in the neutralization include sodium ion, potassium ion and lithium ion. Specific examples of the ionomer resin (1) having a flexural modulus of 100 MPa or greater and 250 MPa or less which is neutralized with a monovalent metal ion include "Himilan 1555" and "Himilan 1601", trade names by Du Pont-MITSUI POLYCHEMICALS Co., Ltd.; and "Surlyn®8528", "Surlyn® 8550", and "Surlyn® 8660", trade names by Dupont.

The amount of the ionomer resin (2) having a flexural modulus of 100 MPa or greater and 250 MPa or less which is neutralized with a bivalent metal ion to be blended is preferably 10 parts by weight or greater and 60 parts by weight or less per 100 parts by weight of the total base polymer. The amount is more preferably equal to or greater than 20 parts by weight, and particularly preferably equal to or greater than 30 parts by weight. Examples of the bivalent metal ion for use in the neutralization include zinc ion, calcium ion, magnesium ion, copper ion, nickel ion and iron ion. Specific examples of the ionomer resin (2) having a flexural modulus of 100 MPa or greater and 250 MPa or less which is neutralized with a bivalent metal ion include "Himilan 1554", "Himilan 1557", "Himilan 1650", "Himilan 1652", "Himilan 1702" and "Himilan 1705", trade names by Du Pont-MITSUI POLYCHEMICALS Co., Ltd.; "Surlyn® 9450", "Surlyn® 9650", "Surlyn® 9730", "Surlyn® 9945" and "Surlyn® 9970", trade names by Dupont; and "IOTEK 720", "IOTEK 730" and "IOTEK 7010", trade names by EXXON Corporation.

The amount of the thermoplastic elastomer containing a styrene block to be blended is preferably 5 parts by weight or greater and 30 parts by weight or less per 100 parts by weight of the total base polymer. The amount is more preferably equal to or greater than 7 parts by weight.

Examples of the thermoplastic elastomer containing a styrene block include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS and hydrogenated SIBS. Exemplary hydrogenated SBS include styrene-ethylene-butylene-styrene block copolymers (SEBS) Exemplary hydrogenated SIS include styrene-ethylene-propylene-styrene block copolymers (SEPS) Exemplary hydrogenated SIBS include styrene-ethylene-ethylene-propylene-styrene block copolymers (SEEPS).

In the present invention, the thermoplastic elastomer containing a styrene block includes alloys of olefin, and one or two or more types of copolymers selected from the group consisting of SBS, SIS, SIBS, SEBS, SEPS and SEEPS and hydrogenated products thereof. Olefin component in this alloy is presumed to be responsible for improvement of compatibility between the thermoplastic elastomer and the ionomer resin. Use of this alloy improves the resilience performance of the golf ball 2. Preferably, olefin having 2 to 10 carbon atoms is used. Ethylene, propylene, butane and pentene are particularly preferred.

Content of the styrene component in the thermoplastic elastomer containing a styrene block is preferably 10% by weight or greater and 50% by weight or less. When the content is less than the above range, the resilience performance of the golf ball 2 may become insufficient. In this respect, the content is more preferably equal to or greater than 12% by weight, and particularly preferably equal to or greater than 15% by weight. When the content is beyond the above range, an insufficient feel at impact of the golf ball 2 may be experienced. In this respect, the content is more preferably equal to or less than 47% by weight, and particularly preferably equal to or less than 45% by weight.

Specific examples of the thermoplastic elastomer containing a styrene block include "Epofriend® A1010", a trade name by Daicel Chemical Industries; "Septon HG-252", a trade name by Kuraray Co., Ltd.; and "Rabalon® SJ5400N", "Rabalon® SJ6400N", "Rabalon® SJ7400N", "Rabalon® SJ8400N", "Rabalon® SJ9400N", "Rabalon® SR04" and "Rabalon® T3339C", trade names by Mitsubishi Chemical Corporation.

For the cover 6, (1) an ionomer resin having a flexural modulus of 100 MPa or greater and 250 MPa or less which is neutralized with a monovalent metal ion, (2) an ionomer resin having a flexural modulus of 100 MPa or greater and 250 MPa or less which is neutralized with a bivalent metal ion, (3) a thermoplastic elastomer containing a styrene block and (4) other polymer may be used in combination. Examples of the other polymer include other ionomer resins, thermoplastic polyurethane elastomers, thermoplastic polyamide elastomers, thermoplastic polyester elastomers and thermoplastic polyolefin elastomers.

Specific examples of the other ionomer resin include "Himilan 1605", "Himilan 1706", "Himilan 1707", "Himilan 1855" and "Himilan 1856", trade names by Du Pont-MITSUI POLYCHEMICALS Co., Ltd.; "Surlyn® 6320", "Surlyn® 8120", "Surlyn®8320", "Surlyn®8945" and "Surlyn®9120", trade names by Dupont; and "IOTEK 820", "IOTEK 830", "IOTEK 7510" and "IOTEK 8000", trade names by EXXON Corporation. Specific examples of the thermoplastic polyurethane elastomer include "Kuramilon 9180" and "Kuramilon 9195", trade names by Kuraray Co., Ltd.; and "Elastolan ET880" and "Elastolan ET890", trade names by BASF Polyurethane Elastomers Co., Ltd. Specific examples of the thermoplastic polyamide elastomer include "Pebax 2533", a trade name by Toray Industries, Inc. Specific examples of the thermoplastic polyester elastomer include "Hytrel®4047", "Hytrel®4767" and "Hytrel®5557", trade names by Du Pont-TORAY Co., LTD.; and "Primalloy® A1500", a trade name by Mitsubishi Chemical Corporation. Specific examples of the thermoplastic polyolefin elastomer include "Milastomer®M4800NW", a trade name by Mitsui Chemicals, Inc.; and "TPE 3682" and "TPE 9455", trade names by Sumitomo Chemical Co., Ltd.

Hardness H3 of the cover 6 is preferably 50 or greater and 60 or less. This cover 6 is soft. The soft cover 6 is responsible for the feel at impact and the control performance of the golf ball 2. When the hardness H3 is less than the above range, the spin may be excessive, which may lead to insufficient flight performance of the golf ball 2. In this respect, the hardness H3 is more preferably equal to or greater than 53, and particularly preferably equal to or greater than 55. In the present invention, the hardness of the cover 6 is measured in accordance with a standard of "ASTM-D 2240-68" with an automated rubber hardness scale which is equipped with a Shore D type spring hardness scale (trade name "LA1", available from Koubunshi Keiki Co., Ltd.). For the measurement, a sheet which is formed by hot press is used having a thickness of about 2 mm and consisting of the polymer composition. Prior to the measurement, the sheet is stored at a temperature of 23° C. for two weeks. Upon the measurement, three sheets are overlaid.

The difference (H3−H1) between the hardness H3 of the cover 6 and the surface hardness H1 of the core 4 is preferably equal to or less than 10. The golf ball 2 having the difference (H3-H1) of equal to or less than 10, the difference (H1−H2) between the surface hardness H1 and the center hardness H2 of 8 or greater and 22 or less, and the surface hardness H1 of 50 or greater and 58 or less achieves a proper deformative behavior of the golf ball 2 upon impact with a golf club. When this golf ball 2 is hit with a driver, it flies with a great launch angle and a small spin rate. This golf ball 2 is excellent in the flight performance. In light of the flight performance, the difference (H3−H1) is more preferably equal to or less than 8. The difference (H3−H1) is equal to or greater than 0, and more preferably equal to or greater than 2.

The cover 6 has a thickness of 1.0 mm or greater and 1.8 mm or less. When the thickness is less than the above range, durability of the golf ball 2 may become insufficient. In this respect, the thickness is more preferably equal to or greater than 1.2 mm, and particularly preferably equal to or greater than 1.4 mm. When the thickness is beyond the above range, the resilience performance of the golf ball 2 may become insufficient. In this respect, the thickness is more preferably equal to or less than 1.6 mm.

An appropriate amount of a coloring agent such as titanium dioxide, a filler such as barium sulfate, a dispersant, an antioxidant, an ultraviolet absorbent, a light stabilizer, a fluorescent agent, a fluorescent brightening agent and the like may be blended to the cover 6 as needed. For the purpose of adjusting the specific gravity, powder of a highly dense metal such as tungsten, molybdenum or the like may be blended to the cover 6. The specific gravity of the cover 6 is 0.80 or greater and 1.20 or less. The cover 6 is usually formed by compression molding or injection molding.

Figure 2:
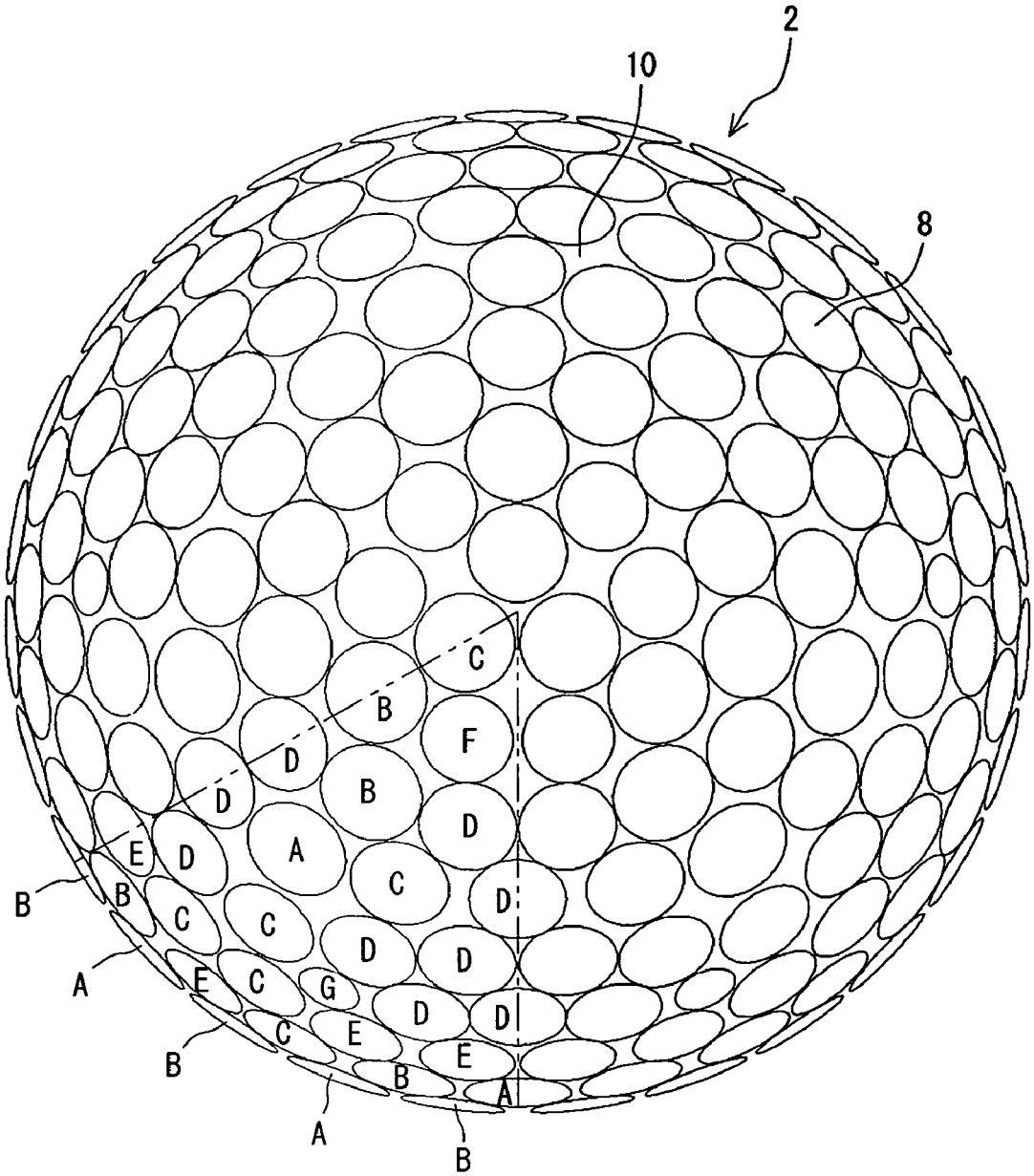
FIG. 2 is an enlarged front view illustrating the golf ball shown in FIG. 1.

FIG. 2 is an enlarged front view illustrating the golf ball 2 shown in FIG. 1. As is clear from FIG. 2, the plane shape of all the dimples 8 is circular. The term "plane shape" herein means a shape of the contour that is a boundary between the phantom spherical face and the dimple 8 viewed at infinity.

In FIG. 2, kinds of the dimples 8 are illustrated by reference symbols A to G with respect to one unit given by comparting the surface of the golf ball 1 into 12 equivalent units. A chain double-dashed line in FIG. 2 shows the phantom sphere representing the boundary between the units. This golf ball 2 has dimples A with a diameter of 4.55 mm, dimples B with a diameter of 4.40 mm, dimples C with a diameter of 4.25 mm, dimples D with a diameter of 4.15 mm, dimples E with a diameter of 4.05 mm, dimples F with a diameter of 3.90 mm and dimples G with the diameter of 2.70 mm. The dimples A to F correspond to the circular dimple (x) having a diameter of 3.90 mm or greater and 4.80 mm or less. This golf ball 2 has 6 kinds of the circular dimples (x) having a diameter of 3.90 mm or greater and 4.80 mm or less. The dimples G correspond to the circular dimple (y) having a diameter of 3.90 mm or less. This golf ball 2 has one kind of circular dimples (y) having a diameter of 3.90 mm or less.

In the golf ball 2 shown in FIG. 2, the number of the dimples A is 42; the number of the dimples B is 72; the number of the dimples C is 66; the number of the dimples D is 84, the number of the dimples E is 42; the number of the dimples F is 12; and the number of the dimples G is 12. Total number N of the dimples 8 of this golf ball 2 is 330. According to this golf ball 2, the number Na of the circular dimples (x) having a diameter of 3.90 mm or greater and 4.80 mm or less is 318. Proportion PN of the number Na to the total number N is 96.4%.

Figure 3:
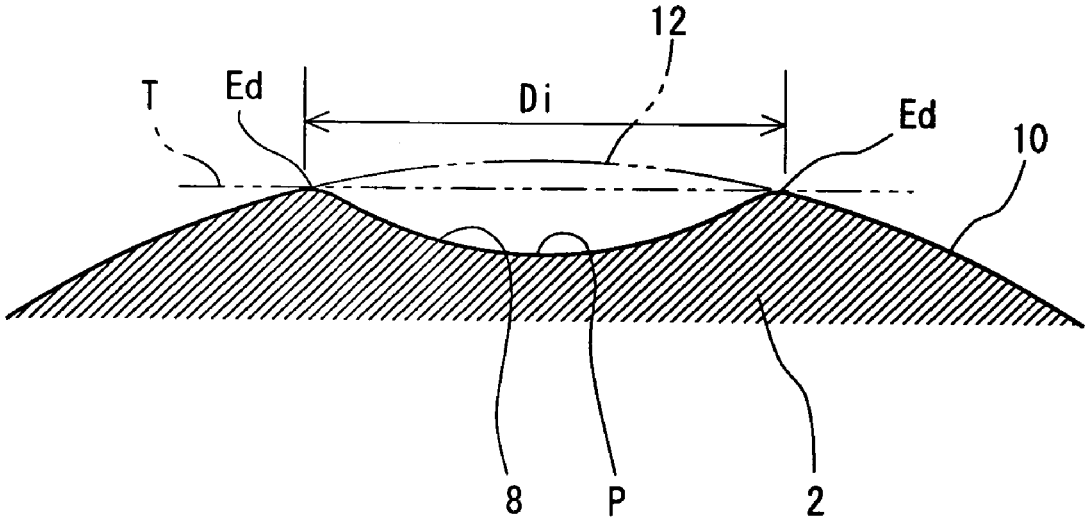
FIG. 3 is an enlarged cross-sectional view illustrating a part of the golf ball 1 shown in FIG. 1.

FIG. 3 is a schematic enlarged cross-sectional view illustrating a part of the golf ball 2 shown in FIG. 2. In this Figure, a cross-section is illustrated which is provided by a plane passing through the weighted center of the plane shape of the dimple 10 and the center of the golf ball 2. As is clear from this Figure, cross-sectional shape of the dimple 8 is nearly a circular arc. In other words, the dimple 8 is a part of a spherical face. This dimple 8 is referred to as a single radius dimple. As a matter of course, a circular dimple having other cross-sectional shape may be also adopted. What is indicated by a chain double-dashed line in FIG. 3 is a phantom sphere. The surface of the phantom sphere 12 is a surface of the golf ball 2 to be present when it is postulated that there exists no dimple 8. What is indicated by a both-sided arrowhead Di in FIG. 3 is the diameter of the dimple 8. This diameter Di is the distance between both contact points Ed when a tangent line T that is common to both sides of the dimple 8 is depicted. The contact points Ed also constitute the edge of the dimple 8. Consecutively aligned edges Ed form the contour of the dimple 8.

"Total volume V" herein means a summation of volume v of all the dimples 8. The "volume v of the dimple" herein means, in instances of a circular dimple, the volume of a space surrounded by a plane including the contour, and the surface of the dimple 8. In instances of a noncircular dimple, a circular single radius dimple having the same area with the area of the noncircular dimple and having the same depth with the depth of the noncircular dimple is envisioned, and the volume of this single radius dimple is defined as the volume of the noncircular dimple. A summation of the volume v of the circular dimples (x) having a diameter of 3.90 mm or greater and 4.80 mm or less is Va. Proportion of the volume Va to the total volume V is PV (%). The volume v of the dimple A of the golf ball 2 illustrated in FIG. 2 is 1.140 $mm^3$; the volume v of the dimple B is 1.066 $mm^3$; the volume v of the dimple C is 0.994 $mm^3$; the volume v of the dimple D is 0.948 $mm^3$; the volume v of the dimple E is 0.903 $mm^3$; the volume v of the dimple F is 0.838 $mm^3$; and the volume v of the dimple G is 0.402 $mm^3$. Total volume V in this golf ball 2 is 322.7 $mm^3$; the volume Va is 317.9 $mm^3$; and the proportion PV is 98.5%.

According to the present invention, ratio of the summation S the areas s of all the dimples 8 to the surface area of the phantom sphere 12 is referred to as an occupation ratio Y. The "area s of the dimple" means an area of a plane shape of the dimple 8. In instance of a circular dimple 8, the area s is calculated by the following formula.

$$s=(Di/2)^2*\pi$$

In the golf ball 2 illustrated in FIG. 2, the area s of the dimple A is 16.26 $mm^2$; the area s of the dimple B is 15.21 $mm^2$; the area s of the dimple C is 14.19 $mm^2$; the area s of the dimple D is 13.53 $mm^2$; the area s of the dimple E is 12.88 $mm^2$; the area s of the dimple F is 11.95 $mm^2$; and the area s of the dimple G is 5.73 $mm^2$. Accordingly, total area S of the dimples 8 in this golf ball 2 is 4604.2 $mm^2$. Because the surface area of the phantom sphere 12 of this golf ball 2 is 5754.9 $mm^2$, the occupation ratio Y is 80.0%.

In the golf ball 2 according to the present invention, the proportion PN is set to be equal to or greater than 75%. In other words, a large number of dimples with a great diameter (x) are provided. The dimple with a great diameter suppresses hopping of the golf ball 2. Upon impact of this golf ball 2, a proper trajectory is attained irrespective of the cover 6 being soft. According to this golf ball 2, a great carry is achieved. In light of the flight performance, the proportion PN is more preferably equal to or greater than 85%, and particularly preferably equal to or greater than 90%. Because an extremely great dimple 8 compromises a fundamental feature of the golf ball 2 being a substantial sphere, it is preferred that the dimple 8 having a diameter of greater than 4.80 mm is not provided.

When dimples having a great diameter (x) are provided alone on the surface of the golf ball 2, the area of the region surrounded by multiple dimples (land 10) becomes great. The golf ball 2 having a great area of the land 10 tends to be stalled in the latter trajectory. The stall leads to reduction of the run. In the golf ball 2 according to the present invention, circular dimples having a small diameter (y) of which diameter being less than 3.90 mm are also provided in addition to the dimples having a great diameter (x). This dimple having a small diameter suppresses generation of a land 10 having a great area. A great occupation ratio Y is thereby achieved. Through providing the dimples having a great diameter (x) and the dimples having a small diameter (y), the total distance may be elevated. In light of the occupation ratio Y, the diameter of the dimple having a small diameter is more preferably equal to or less than 3.70 mm, and even more preferably equal to or less than 3.50 mm. Because an extremely small dimple 8 is not responsible for the aerodynamic characteristics, the diameter of the dimple having a small diameter is preferably equal to or greater than 2.00 mm, and more preferably equal to or greater than 2.50 mm. In addition to or in stead of the dimples having a small diameter, noncircular dimples may be provided. The noncircular dimple is readily provided also in the region surrounded by the dimples having a great diameter. Noncircular dimple can suppress the stall similarly to the dimples having a small diameter. In light of the flight performance, proportion of the number of the circular dimples (y) having a diameter of less than 3.90 mm and the noncircular dimples to the total number N is preferably equal to or greater than 1%, and particularly preferably equal to or greater than 2%. In other words, the proportion PN is preferably equal to or less than 99%, and particularly preferably equal to or less than 98%.

This golf ball 2 has six kinds of the dimples having a great diameter (x) as described above. Through providing two or more kinds of the dimples having a great diameter, the dimples 8 can be densely arranged on the surface of the golf ball 2 compared to the case in which a single kind of the dimples having a great diameter are arranged. Accordingly, a great occupation ratio Y can be achieved. According to the present invention, dimples with each other's difference in diameter of 0.05 mm or more are decided as falling within different kinds. In light of the occupation ratio Y, the difference in diameter between the maximum dimple and the minimum dimple among the circular dimples (x) having a diameter of 3.90 mm or greater and 4.80 mm or less is preferably equal to or greater than 0.10 mm, and particularly preferably equal to or greater than 0.15 mm. The number of kinds of the dimple having a small diameter and the noncircular dimple may be one, or two or more.

In the golf ball 2 according to the present invention, the occupation ratio Y is set to be equal to or greater than 75%. When the occupation ratio Y is beyond the above range, the golf ball 2 may be stalled in the latter trajectory, thereby providing an insufficient run. In this respect, the occupation ratio Y is more preferably equal to or greater than 78%, and particularly preferably equal to or greater than 80%. Generally provided occupation ratio Y is equal to or less than 90%, and particularly, equal to or less than 86%.

In the golf ball 2 according to the present invention, the total volume V is preferably 250 $mm^3$ or greater and 380 $mm^3$ or less. When the total volume V is less than the above range, the run may be insufficient. In this respect, the total volume V is more preferably equal to or greater than 270 $mm^3$, and particularly preferably equal to or greater than 290 $mm^3$. When the total volume V is beyond the above range, the carry may be insufficient. In this respect, the total volume V is more preferably equal to or less than 375 $mm^3$, and particularly preferably equal to or less than 370 $mm^3$.

In the golf ball 2 according to the present invention, the volume Va is greater than 300 $mm^3$. In other words, the proportion PV of the volume Va to the total volume V is great. According to this golf ball 2, a great carry is achieved. In light of the carry, PV is preferably greater than 95%, and more preferably equal to or greater than 96%. In order to achieve a great run, the noncircular dimple or the circular dimple (y) having a diameter of less than 3.90 mm is also required, as described above. In light of the run, PV is preferably equal to or less than 99.5%.

In the golf ball 2 according to the present invention, total number N of the dimples 8 is 240 or greater and 360 or less. When the total number N is less than the above range, a fundamental feature of the golf ball 2 being a substantial sphere is compromised. In this respect, the total number N is more preferably equal to or greater than 280. When the total number N is beyond the above range, a drag coefficient (Cd) may be increased thereby resulting in an insufficient carry. In this respect, the total number N is more preferably equal to or less than 350.

The depth of the respective dimples 8 is preferably 0.05 mm or greater and 0.60 mm or less. When the depth is less than the above range, the aerodynamic characteristic of the golf ball 2 may be insufficient. In this respect, the depth is more preferably equal to or greater than 0.075 mm, and particularly preferably equal to or greater than 0.10 mm. When the depth is beyond the above range, the dimple 8 is liable to be clogged with sand dust. In this respect, the depth is more preferably equal to or less than 0.50 mm, and particularly preferably equal to or less than 0.45 mm. The depth refers to a distance between a plane including the contour of the dimple 8 and the deepest point P of the dimple 8.

EXAMPLES

Example 1

A rubber composition was obtained by kneading 100 parts by weight of polybutadiene (trade name "BR-18", available from JSR Corporation), 31 parts by weight of zinc diacrylate, 5.0 parts by weight of zinc oxide, 14.0 parts by weight of barium sulfate, 0.5 part by weight of diphenyl disulfide and 0.8 part by weight of dicumyl peroxide. This rubber composition was placed into a mold having upper and lower mold half each having a hemispherical cavity, and heated at a temperature of 170° C. for 15 minutes to obtain a core having a diameter of 39.6 mm. This core is of the type (iii) presented in Table 1 below. On the other hand, a resin composition was obtained by kneading 45 parts by weight of a binary ionomer resin neutralized with sodium ("Himilan 1555" as described above), 45 parts by weight of a binary ionomer resin neutralized with zinc ("Himilan 1557" as described above) 10 parts by weight of a thermoplastic elastomer containing a styrene block ("Rabalon® SR04" as described above) and 3 parts of titanium dioxide. This resin composition is of the type (a) presented in Table 2 below. The aforementioned core was placed into a mold having numerous protrusions on the inside face, followed by injection of the aforementioned resin composition around the core according to injection molding method to form a cover having a thickness of 1.6 mm. Numerous dimples having a shape inverted from the shape of the protrusion were formed on the cover. Specifications of this dimple are of the type I presented in Table 3 below. Paint was applied on this cover to give a golf ball of Example 1 having a diameter of about 42.8 mm and a weight of about 45.4 g.

Examples 2 to 4 and Comparative Examples 1 to 2

In a similar manner to Example 1 except that the specifications of the core were set to be as presented in Table 4 below, golf balls of Examples 2 to 4 and Comparative Examples 1 to 2 were obtained. Detailed specifications of the core are presented in Table 1 below.

Comparative Examples 3 to 5

In a similar manner to Example 1 except that specifications of the dimples were set to be as presented in Table 5 below, golf balls of Comparative Examples 3 to 5 were obtained. Detailed specifications of the dimples are presented in Table 3 below.

Examples 5 to 6 and Comparative Examples 6 to 8

In a similar manner to Example 1 except that the specifications of the cover were set to be as presented in Table 5 below, golf balls of Examples 5 to 6 and Comparative Examples 6 to 8 were obtained. Detailed specifications of the cover are presented in Table 2 below.

TABLE 1

| Specification of core | | | | | | |
|---|---|---|---|---|---|---|
| Type | i | ii | iii | iv | v | vi |
| BR18 | 100 | 100 | 100 | 100 | 100 | 100 |
| Zinc diacrylate | 26 | 29 | 31 | 35 | 31 | 31 |
| Zinc oxide | 5.0 | 5.0 | 5.0 | 5.0 | 5.0 | 5.0 |
| Barium sulfate | 16.0 | 14.8 | 14.0 | 13.2 | 14.2 | 13.5 |
| Diphenyl disulfide | 0.5 | 0.5 | 0.5 | 0.5 | 0.5 | 0.5 |
| Dicumyl peroxide | 0.8 | 0.8 | 0.8 | 0.8 | 0.8 | 0.8 |
| Diameter (mm) | 39.6 | 39.6 | 39.6 | 39.6 | 38.6 | 41.0 |

TABLE 2

| Resin composition of cover | | | | | | |
|---|---|---|---|---|---|---|
| Type | a | b | c | d | e | f |
| Binary ionomer resin neutralized with sodium, Himilan 1555 (flexural modulus: 205 MPa) | 45 | — | — | — | — | 40 |
| Binary ionomer resin neutralized with zinc, Himilan 1557 (flexural modulus: 215 MPa) | 45 | — | — | — | — | 40 |

TABLE 2-continued

| Resin composition of cover | | | | | | |
|---|---|---|---|---|---|---|
| Type | a | b | c | d | e | f |
| Binary ionomer resin neutralized with sodium, Himilan 1605 (flexural modulus: 295 MPa) | — | — | — | 40 | — | — |
| Binary ionomer resin neutralized with sodium, Surlyn ® 9945 (flexural modulus: 338 MPa) | — | — | — | 40 | — | — |
| Ternary ionomer resin neutralized with zinc, Himilan 1855 (flexural modulus: 87 MPa) | — | 45 | 40 | — | — | 20 |
| Ternary ionomer resin neutralized with sodium, Himilan 1856 (flexural modulus: 93 MPa) | — | — | 40 | — | — | — |
| Ternary ionomer resin neutralized with sodium, Surlyn ® 8320 (flexural modulus: 19.3 MPa) | — | 45 | — | — | — | — |
| Binary ionomer resin neutralized with sodium, Surlyn ® 8120 (flexural modulus: 55 MPa) | — | — | — | — | 40 | — |
| Binary ionomer resin neutralized with zinc, Surlyn ® 9120 (flexural modulus: 440 MPa) | — | — | — | — | 40 | — |
| Thermoplastic elastomer containing a styrene block Rabalon ® SR04 | 10 | 10 | 20 | 20 | 20 | — |
| Titanium dioxide | 3 | 3 | 3 | 3 | 3 | 3 |
| Hardness (Shore D) | 56 | 45 | 50 | 60 | 66 | 56 |

[Travel Distance Test]

A driver with a metal head (trade name "XXIO", available from Sumitomo Rubber Industries, Ltd., shaft hardness: S, loft: angle 10°) was equipped with a swing machine available from True Temper Co. Then the golf ball was hit under a condition to give the head speed of 45 m/sec with this driver. Accordingly, launch angle, back spin rate immediately after the impact, carry, run and total distance were measured. Mean values of 12 times measurement are presented in Table 4 and Table 5 below.

[Evaluation of Durability]

Under the equal condition to that for the travel distance test as described above, the golf ball was hit in succession. In instances where the golf ball was not broken upon 100 times hitting, it was evaluated as "favorable"; and in instances where the golf ball was broken before the number of hitting reaches to 100, it was evaluated as "unfavorable". The results are presented in Table 4 and Table 5 below.

[Evaluation of Feel at Impact]

The golf ball was hit by a golf player with a driver, and the evaluation of the feel at impact was rendered to classify into three ranks of from "A" to "C". The results are presented in Table 4 and Table 5 below.

TABLE 3

| Specification of dimple | | | | | | | |
|---|---|---|---|---|---|---|---|
| | Number | Shape | Diameter (mm) | Depth (mm) | Volume ($mm^3$) | Area ($mm^2$) | Pattern |
| Type I | | | | | | | |
| Dimple A | 42 | Circular | 4.550 | 0.1400 | 1.140 | 16.26 | FIG. 2 |
| Dimple B | 72 | Circular | 4.400 | 0.1400 | 1.066 | 15.21 | |
| Dimple C | 66 | Circular | 4.250 | 0.1400 | 0.994 | 14.19 | |
| Dimple D | 84 | Circular | 4.150 | 0.1400 | 0.948 | 13.53 | |
| Dimple E | 42 | Circular | 4.050 | 0.1400 | 0.903 | 12.88 | |
| Dimple F | 12 | Circular | 3.900 | 0.1400 | 0.838 | 11.95 | |
| Dimple G | 12 | Circular | 2.700 | 0.1400 | 0.402 | 5.73 | |
| Type II | | | | | | | |
| Dimple A | 42 | Circular | 4.650 | 0.1320 | 1.122 | 16.98 | FIG. 2 |
| Dimple B | 72 | Circular | 4.450 | 0.1320 | 1.028 | 15.55 | |
| Dimple C | 66 | Circular | 4.250 | 0.1350 | 0.959 | 14.19 | |
| Dimple D | 84 | Circular | 4.100 | 0.1450 | 0.959 | 13.20 | |
| Dimple E | 42 | Circular | 4.000 | 0.1510 | 0.951 | 12.57 | |
| Dimple F | 12 | Circular | 3.800 | 0.1570 | 0.892 | 11.34 | |
| Dimple G | 12 | Circular | 3.100 | 0.1600 | 0.606 | 7.55 | |
| Type III | | | | | | | |
| Dimple A | 42 | Circular | 4.650 | 0.1400 | 1.190 | 16.98 | FIG. 2 |
| Dimple B | 72 | Circular | 4.450 | 0.1400 | 1.090 | 15.55 | |
| Dimple C | 66 | Circular | 4.300 | 0.1400 | 1.018 | 14.52 | |
| Dimple D | 84 | Circular | 4.150 | 0.1400 | 0.948 | 13.53 | |
| Dimple E | 42 | Circular | 3.800 | 0.1400 | 0.795 | 11.34 | |
| Dimple F | 12 | Circular | 3.700 | 0.1400 | 0.754 | 10.75 | |
| Dimple G | 12 | Circular | 2.800 | 0.1400 | 0.432 | 6.16 | |
| Type IV | | | | | | | |
| Dimple A | 42 | Circular | 4.650 | 0.1600 | 1.361 | 16.98 | FIG. 2 |
| Dimple B | 72 | Circular | 4.480 | 0.1500 | 1.184 | 15.76 | |
| Dimple C | 66 | Circular | 4.420 | 0.1400 | 1.076 | 15.34 | |
| Dimple D | 84 | Circular | 3.820 | 0.1400 | 0.804 | 11.46 | |
| Dimple E | 42 | Circular | 3.720 | 0.1300 | 0.708 | 10.87 | |
| Dimple F | 12 | Circular | 3.620 | 0.1200 | 0.618 | 10.29 | |
| Dimple G | 12 | Circular | 2.800 | 0.1200 | 0.370 | 6.16 | |

TABLE 4

Results of evaluation

| | Example 2 | Example 3 | Example 1 | Example 4 | Comp. Example 1 | Comp. Example 2 |
|---|---|---|---|---|---|---|
| Core | | | | | | |
| Type | i | ii | iii | iv | v | vi |
| Amount of compressive deformation (mm) | 4.2 | 3.7 | 3.3 | 2.8 | 3.2 | 3.4 |
| Surface hardness H1 (Shore D) | 50 | 53 | 54 | 56 | 54 | 54 |
| Center hardness H2 (Shore D) | 37 | 39 | 40 | 42 | 39 | 39 |
| Difference of hardness (H1 − H2) | 13 | 14 | 14 | 12 | 15 | 15 |
| Cover | | | | | | |
| Type | a | a | a | a | a | a |
| Thickness (mm) | 1.6 | 1.6 | 1.6 | 1.6 | 2.1 | 0.8 |
| Hardness H3 (Shore D) | 56 | 56 | 56 | 56 | 56 | 56 |
| Amont of Rabalon (parts by weight) | 10 | 10 | 10 | 10 | 10 | 10 |
| Dimple | | | | | | |
| Type | I | I | I | I | I | I |
| Total number N | 330 | 330 | 330 | 330 | 330 | 330 |
| Number Na | 318 | 318 | 318 | 318 | 318 | 318 |
| Proportion PN (%) | 96.4 | 96.4 | 96.4 | 96.4 | 96.4 | 96.4 |
| Total volume V ($mm^3$) | 322.7 | 322.7 | 322.7 | 322.7 | 322.7 | 322.7 |
| Volume Va ($mm^3$) | 317.9 | 317.9 | 317.9 | 317.9 | 317.9 | 317.9 |
| Proportion PV (%) | 98.5 | 98.5 | 98.5 | 98.5 | 98.5 | 98.5 |
| Occupation ratio (%) | 80.0 | 80.0 | 80.0 | 80.0 | 80.0 | 80.0 |
| Difference of hardness (H3 − H1) | 6 | 28 3 | 2 | 0 | 2 | 2 |
| Amount of compressive deformation of ball (mm) | 3.8 | 3.3 | 3.0 | 2.4 | 2.9 | 3.2 |
| Launch angle (degree) | 11.8 | 11.6 | 11.5 | 11.0 | 11.6 | 11.3 |
| Spin rate (rpm) | 2520 | 2600 | 2700 | 2830 | 2640 | 2860 |
| Carry (m) | 216 | 220 | 218 | 216 | 212 | 213 |
| Run (m) | 8 | 7 | 7 | 6 | 7 | 6 |
| Total distance (m) | 224 | 227 | 225 | 222 | 219 | 219 |
| Durability | Favorable | Favorable | Favorable | Favorable | Favorable | Unfavorable |
| Feel at impact | B | A | A | A | B | B |

TABLE 5

Results of evaluation

| | Comp. Example 3 | Comp. Example 4 | Comp. Example 5 | Example 5 | Example 6 | Comp. Example 6 | Comp. Example 7 | Comp. Example 8 |
|---|---|---|---|---|---|---|---|---|
| Core | | | | | | | | |
| Type | iii | iii | iii | iii | iii | iii | iii | iii |
| Amount of compressive deformation (mm) | 3.3 | 3.3 | 3.3 | 3.3 | 3.3 | 3.3 | 3.3 | 3.3 |
| Surface hardness H1 (Shore D) | 54 | 54 | 54 | 54 | 54 | 54 | 54 | 54 |
| Center hardness H2 (Shore D) | 40 | 40 | 40 | 40 | 40 | 40 | 40 | 40 |
| Difference of hardness (H1 − H2) | 14 | 14 | 14 | 14 | 14 | 14 | 14 | 14 |
| Cover | | | | | | | | |
| Type | a | a | a | c | d | b | e | f |
| Thickness (mm) | 1.6 | 1.6 | 1.6 | 1.6 | 1.6 | 1.6 | 1.6 | 1.6 |
| Hardness H3 (Shore D) | 56 | 56 | 56 | 50 | 60 | 45 | 66 | 56 |
| Amont of Rabalon (parts by weight) | 10 | 10 | 10 | 20 | 20 | 10 | 20 | — |
| Dimple | | | | | | | | |
| Type | II | III | IV | I | I | I | I | I |
| Total number N | 330 | 330 | 330 | 330 | 330 | 330 | 330 | 330 |
| Number Na | 306 | 264 | 180 | 318 | 318 | 318 | 318 | 318 |
| Proportion PN (%) | 92.7 | 80.0 | 54.5 | 96.4 | 96.4 | 96.4 | 96.4 | 96.4 |
| Total volume V ($mm^3$) | 322.8 | 323.0 | 322.5 | 322.7 | 322.7 | 322.7 | 322.7 | 322.7 |
| Volume Va ($mm^3$) | 304.9 | 275.3 | 213.4 | 317.9 | 317.9 | 317.9 | 317.9 | 317.9 |
| Proportion PV (%) | 94.4 | 85.2 | 66.2 | 98.5 | 98.5 | 98.5 | 98.5 | 98.5 |
| Occupation ratio (%) | 80.5 | 80.1 | 77.8 | 80.0 | 80.0 | 80.0 | 80.0 | 80.0 |
| Difference of hardness (H3 − H1) | 2 | 2 | 2 | −4 | 6 | −9 | 12 | 2 |
| Amount of compressive deformation of ball (mm) | 3.0 | 3.0 | 3.0 | 3.1 | 2.9 | 3.2 | 2.8 | 3.0 |
| Launch angle (degree) | 11.5 | 11.5 | 11.5 | 11.4 | 11.6 | 11.2 | 11.7 | 11.5 |
| Spin rate (rpm) | 2700 | 2700 | 2700 | 2780 | 2620 | 2910 | 2540 | 2730 |
| Carry (m) | 213 | 210 | 208 | 215 | 219 | 212 | 220 | 214 |

TABLE 5-continued

| | Results of evaluation | | | | | | | |
|---|---|---|---|---|---|---|---|---|
| | Comp. Example 3 | Comp. Example 4 | Comp. Example 5 | Example 5 | Example 6 | Comp. Example 6 | Comp. Example 7 | Comp. Example 8 |
| Run (m) | 7 | 6 | 5 | 6 | 8 | 5 | 8 | 6 |
| Total distance (m) | 220 | 216 | 213 | 221 | 227 | 217 | 228 | 220 |
| Durability | Favorable | Favorable | Favorable | Favorable | Favorable | Favorable | Unfavorable | Favorable |
| Feel at impact | A | A | A | B | B | C | C | B |

As is shown in Table 4 and Table 5, the golf ball of Examples is excellent in the flight performance, durability and feel at impact. Therefore, advantages of the present invention are clearly suggested by these results of evaluation.

The golf ball according to the present invention is suited for playing on a golf course, and for practicing on a driving range.

The description herein above is just for an illustrative example, therefore, various modifications can be made without departing from the principles of the present invention.

What is claimed is:

1. A golf ball having a core, a cover and 240 or more and 360 or less dimples, said cover comprising an ionomer resin and a thermoplastic elastomer containing a styrene block as a principal component, and having a thickness of 1.0 mm or greater and 1.8 mm or less and a hardness of 50 or greater and 60 or less, said dimples comprising (x) two or more kinds of circular dimples having a diameter of 3.90 mm or greater and 4.80 mm or less, and (y) noncircular dimples, or circular dimples having a diameter of less than 3.90 mm, proportion PN of the number Na of the circular dimples (x) having a diameter of 3.90 mm or greater and 4.80 mm or less to a total number N of the dimples being equal to or greater than 75%, volume Va of the circular dimples (x) having a diameter of 3.90 mm or greater and 4.80 mm or less being greater than 300 $mm^3$, proportion PV of said volume Va to a total volume V of all the dimples being greater than 95.0%, and occupation ratio of total area of the dimples to the surface area of a phantom sphere being equal to or greater than 75%.

2. The golf ball according to claim 1 wherein said cover comprises:

(1) 10 parts by weight or greater and 60 parts by weight or less of an ionomer resin having a flexural modulus of 100 MPa or greater and 250 MPa or less which is neutralized with a monovalent metal ion, (2) 10 parts by weight or greater and 60 parts by weight or less of an ionomer resin having a flexural modulus of 100 MPa or greater and 250 MPa or less which is neutralized with a bivalent metal ion and (3) 5 parts by weight or greater and 30 parts by weight or less of a thermoplastic elastomer containing a styrene block, as a principal component.

3. The golf ball according to claim 1 wherein said core is constituted through crosslinking of a rubber composition, said rubber composition comprising 100 parts by weight of a base polymer including polybutadiene as a principal component, 20 parts by weight or greater and 45 parts by weight or less of an unsaturated carboxylic acid having 3 to 8 carbon atoms or a metal salt thereof, 0.1 part by weight or greater and 5.0 parts by weight or less of an organic peroxide, and 0.1 part by weight or greater and 5.0 parts by weight or less of an organic sulfur compound, amount of compressive deformation of said core being 3.0 mm or greater and 4.0 mm or less, surface hardness of said core being 50 or greater and 58 or less, the difference between the surface hardness and the center hardness of said core being 8 or greater and 22 or less, and the difference between the hardness of the cover and the surface hardness of the core being equal to or less than 10.

4. The golf ball according to claim 1 wherein the proportion PN is equal to or greater than 85%.

5. The golf ball according to claim 1 wherein the proportion PN is equal to or greater than 90%.

6. The golf ball according to claim 1 wherein the proportion PV is equal to or greater than 96%.

7. The golf ball according to claim 1 wherein the proportion PV is equal to or less than 99.5%.

* * * * *